US007772169B2

(12) United States Patent
Barnes et al.

(10) Patent No.: US 7,772,169 B2
(45) Date of Patent: Aug. 10, 2010

(54) LOW ASH STATIONARY GAS ENGINE LUBRICANT

(75) Inventors: W. Preston Barnes, Concord, OH (US); Virginia A. Carrick, Chardon, OH (US); Sara B. Pocinki, Cleveland, OH (US); Jayram D. Patel, Eastlake, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 880 days.

(21) Appl. No.: 10/515,365

(22) PCT Filed: May 14, 2003

(86) PCT No.: PCT/US03/15065

§ 371 (c)(1),
(2), (4) Date: Jul. 18, 2005

(87) PCT Pub. No.: WO03/099972

PCT Pub. Date: Dec. 4, 2003

(65) Prior Publication Data

US 2006/0052256 A1 Mar. 9, 2006

Related U.S. Application Data

(60) Provisional application No. 60/382,963, filed on May 24, 2002.

(51) Int. Cl.
*C10M 133/56* (2006.01)
*C10M 159/24* (2006.01)
*C10M 159/22* (2006.01)
*C10M 129/54* (2006.01)

(52) U.S. Cl. ..... 508/291; 508/294; 508/518; 508/391

(58) Field of Classification Search ..... 508/294, 508/291, 391, 518
See application file for complete search history.

(56) References Cited

U.S. PATENT DOCUMENTS

| | | | | |
|---|---|---|---|---|
| 4,248,725 | A | 2/1981 | Crawford et al. | |
| 5,259,967 | A | 11/1993 | Ripple | |
| 5,439,605 | A * | 8/1995 | Khorramian | 508/198 |
| 5,498,809 | A * | 3/1996 | Emert et al. | 585/13 |
| 5,523,007 | A * | 6/1996 | Kristen et al. | 508/297 |
| 5,726,133 | A * | 3/1998 | Blahey et al. | 508/390 |
| 5,744,430 | A | 4/1998 | Inoue et al. | |
| 6,147,035 | A | 11/2000 | Shimada et al. | |
| 6,207,624 | B1 * | 3/2001 | Stachew et al. | 508/290 |
| 6,299,655 | B1 | 10/2001 | Steckel et al. | |
| 6,423,670 | B2 | 7/2002 | Locke et al. | |
| 6,756,348 | B2 * | 6/2004 | Palazzotto et al. | 508/503 |
| 2001/0036906 | A1 | 11/2001 | Locke et al. | |
| 2002/0019320 | A1 | 2/2002 | Nakazato et al. | |

FOREIGN PATENT DOCUMENTS

| | | |
|---|---|---|
| CA | 2314196 | 1/2002 |
| EP | 0 528610 | 2/1993 |
| EP | 0 686689 | 12/1995 |
| EP | 0 725129 | 8/1996 |
| EP | 1167497 | 1/2002 |
| EP | 1 195 426 A | 6/2003 |
| JP | 2007-258678 | 10/1995 |
| JP | 11 152 485 | 6/1999 |
| JP | 2000 256 690 | 9/2000 |
| WO | 8605501 | 9/1986 |

OTHER PUBLICATIONS

Machine Translation of JP 2007-258678A.
Abstract of JP 2007-258678A, Patent Abstracts of Japan.

* cited by examiner

*Primary Examiner*—Glenn Caldarola
*Assistant Examiner*—Jim Goloboy
(74) *Attorney, Agent, or Firm*—David M. Shold; Christopher D. Hilker

(57) ABSTRACT

A low-ash, low-phosphorus lubricant composition suitable for use in a stationary gas engine includes an oil of lubricating viscosity, 1.5 to 8 percent of a succinimide dispersant, 0.8 to 4.0 percent of a hindered, ester-substituted phenol antioxidant, and at least one metal-containing sulfonate detergent or metal-containing phenate detergent, in an amount which provides 1.1 to 2.1 percent by weight of said sulfonate or phenate moieties exclusive of the weight of the metal moieties. The lubricant contains up to 0.08 percent by weight phosphorus and up to 1.25 percent sulfated ash.

13 Claims, No Drawings

LOW ASH STATIONARY GAS ENGINE LUBRICANT

CROSS-REFERENCE TO RELATED APPLICATION

This application claims priority from U.S. provisional application 60/382,963, filed May 24, 2002.

BACKGROUND OF THE INVENTION

The present invention relates to lubricating oil compositions which provide high performance standards particularly in stationary gas engines.

There is continuous need for improving the performance characteristics of engines, in particular stationary gas engines, and the lubricating oils used therein. Stationary gas engines are typically large, heavy duty, stationary engines designed to run on natural gas and other like fuels. Trends in such engines include the development of smaller four-cycle, lean burning engines, for which high performance lubricants are important.

There has been a great deal of research reported on various lubricant formulations to solve specific problems. For example, U.S. Pat. No. 5,259,967, Ripple, Nov. 9, 1993, discloses a lubricating oil composition providing less than 1% sulfated ash, comprising an additive package of a carboxylic dispersant, a rust inhibiting mixture, a hydrocarbyl substituted phenol, and a neutralized acid or phenol. The lubricant can be used in gasoline and diesel engines.

European Patent Publication EP 725129 A, Aug. 7, 1996, discloses a low sulfate ash lubricating oil composition comprising an oil of lubricating viscosity, a calcium overbased acidic material, a magnesium overbased material, and a combination of an alkylene-coupled hindered phenol antioxidant and another antioxidant, particularly useful for lubricating stationary gas engines.

PCT Patent Publication WO 01/74978, Oct. 11, 2001, discloses compositions suitable for use as lubricant additives which contain an ester-substituted hindered phenol antioxidant and other additives suitable for lubricants such as a detergent or a dispersant.

U.S. Pat. No. 6,147,035, Sougawa et al, Nov. 24, 2000, discloses a lubricating oil composition containing overbased metal salicylate, amine antioxidant, phenol antioxidant, polyalkenylsuccinimide, and zinc dialkyldithiophosphate. The lubricant is suitable as a long-life engine oil for gas engine heat pumps.

Many stationary gas lubricant formulations produce an undesirable amount of piston deposits during field use. It has been observed that a correlation exists between high levels of nitration of the lubricant during service, and these unacceptable piston deposits. The present invention focuses on improving piston deposits in such engines by way of reducing the extent of nitration of the lubricant.

SUMMARY OF THE INVENTION

Therefore, the present invention provides a low-ash, low-phosphorus lubricant composition suitable for use in a stationary gas engine, comprising:

(a) an oil of lubricating viscosity;

(b) 1.5 to 8 percent by weight of a succinimide dispersant;

(c) 0.8 to 4.0 percent by weight of a hindered, ester-substituted phenol antioxidant; and (d) at least one metal-containing sulfonate detergent or metal-containing phenate detergent, in an amount which provides 1.1 to 2.1 percent by weight of said sulfonate or phenate moieties exclusive of the weight of the metal moieties;

said lubricant containing up to 0.08 percent by weight phosphorus and up to 1.25 percent sulfated ash.

The present invention also provides a method of lubricating a stationary gas engine, comprising supplying to said engine the above-defined lubricant.

DETAILED DESCRIPTION OF THE INVENTION

Various preferred features and embodiments will be described below by way of non-limiting illustration.

The lubricants of the present invention include crankcase lubricating oils for spark-ignited and compression-ignited internal combustion engines, including automobile and truck engines, two-cycle engines, aviation piston engines, and marine and railroad diesel engines. They can also be used in gas engines, stationary power engines, and turbines. Automatic transmission fluids, transaxle lubricants, gear lubricants, metal-working lubricants, hydraulic fluids and other lubricating oil and grease compositions can also benefit from the incorporation therein of the compositions of the present invention.

The Oil of Lubricating Viscosity. Oils of lubricating viscosity include natural and synthetic lubricating oils and mixtures thereof.

Natural oils include animal oils and vegetable oils (e.g., castor oil, lard oil) as well as liquid petroleum oils and solvent-treated or acid-treated mineral lubricating oils of the paraffinic, naphthenic or mixed paraffinic-naphthenic types. Oils of lubricating viscosity derived from coal or shale are also useful base oils. Synthetic lubricating oils include hydrocarbon oils such as polymerized and interpolymerized olefins (e.g., polybutylenes, polypropylenes, propylene-isobutylene copolymers, poly(1-hexenes, poly(1-octenes), poly (1decenes), and mixtures thereof); alkylbenzenes (e.g., dodecylbenzenes, tetradecylbenzenes, dinonylbenzenes, and di(2-ethylhexyl)-benzenes); polyphenyls (e.g., biphenyls, terphenyls, and alkylated polyphenyls), alkylated diphenyl ethers and alkylated diphenyl sulfides and the derivatives, analogs, and homologs thereof.

Alkylene oxide polymers and interpolymers and derivatives thereof where the terminal hydroxyl groups have been modified by esterification, etherification, or similar reaction constitute another class of known synthetic lubricating oils. These are exemplified by the oils prepared through polymerization of ethylene oxide or propylene oxide, the alkyl and aryl ethers of these polyoxyalkylene polymers Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkyl malonic acids, and alkenyl malonic acids) with a variety of alcohols (e.g., butyl alcohol, hexyl alcohol, dodecyl alcohol, 2-ethylhexyl alcohol, ethylene glycol, diethylene glycol monoether, and propylene glycol). Specific examples of these esters include dibutyl adipate, di(2-ethylhexyl sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol, and tripentaerythritol. Esters can also be monoesters, such as are available under the trade name Priolube 1976™ ($C_{18}$-alkyl-COO—$C_{20}$ alkyl).

Unrefined, refined and rerefined oils (and mixtures of each with each other) of the type disclosed hereinabove can be used in the lubricant compositions of the present invention. Other oils that can be used are oils prepared from a gas-to-liquid process such as those involving Fischer-Tropsch processing.

The amount of lubricating oil in a fully formulated lubricant of the present invention (including the diluent or carrier oils present in additive packages) is typically 80 to 99.5 weight percent, preferably 85 to 96 weight percent, and more preferably 90 to 95 weight percent. The lubricating oil can also be used to prepare concentrates containing the additives of the present invention in higher concentrations. The amount of such oil in a concentrate is typically 20 to 80 weight percent.

The Succinimide Dispersant. Succinimide dispersants are well known in the field of lubricants and include primarily what are sometimes referred to as "ashless" dispersants because (prior to mixing in a lubricating composition) they do not contain ash-forming metals and they do not normally contribute any ash forming metals when added to a lubricant. Succinimide dispersants are the reaction product of a hydrocarbyl substituted succinic acylating agent with an organic hydroxy compound or, preferably, an amine containing at least one hydrogen attached to a nitrogen atom, or a mixture of said hydroxy compound and amine. The term "succinic acylating agent" refers to a hydrocarbon-substituted succinic acid or succinic acid-producing compound (which term also encompasses the acid itself). Such materials typically include hydrocarbyl-substituted succinic acids, anhydrides, esters (including half esters) and halides.

Succinic based dispersants have a wide variety of chemical structures including typically structures such as

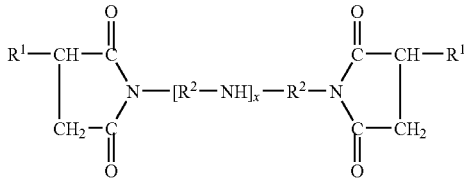

In the above structure, each $R^1$ is independently a hydrocarbyl group, preferably a polyolefin-derived group having an $\overline{M}_n$ of 500 or 700 to 10,000. Typically the hydrocarbyl group is an alkyl group, frequently a polyisobutyl group with a molecular weight of 500 or 700 to 5000, preferably 1500 or 2000 to 5000. Alternatively expressed, the $R^1$ groups can contain 40 to 500 carbon atoms and preferably at least 50, e.g., 50 to 300 carbon atoms, preferably aliphatic carbon atoms. The $R^2$ are alkylene groups, commonly ethylene ($C_2H_4$) groups. Such molecules are commonly derived from reaction of an alkenyl acylating agent with a polyamine, and a wide variety of linkages between the two moieties is possible beside the simple imide structure shown above, including a variety of amides and quaternary ammonium salts. Succinimide dispersants are more fully described in U.S. Pat. Nos. 4,234,435 and 3,172,892.

The polyalkenes from which the substituent groups are derived are typically homopolymers and interpolymers of polymerizable olefin monomers of 2 to 16 carbon atoms; usually 2 to 6 carbon atoms.

The olefin monomers from which the polyalkenes are derived are polymerizable olefin monomers characterized by the presence of one or more ethylenically unsaturated groups (i.e., >C═C<); that is, they are mono-olefinic monomers such as ethylene, propylene, 1-butene, isobutene, and 1-octene or polyolefinic monomers (usually diolefinic monomers) such as 1,3-butadiene, and isoprene. These olefin monomers are usually polymerizable terminal olefins; that is, olefins characterized by the presence in their structure of the group >C═$CH_2$. Relatively small amounts of non-hydrocarbon substituents can be included in the polyolefin, provided that such substituents do not substantially interfere with formation of the substituted succinic acid acylating agents.

Each $R^1$ group may contain one or more reactive groups, e.g., succinic groups, thus being represented (prior to reaction with the amine) by structures such as

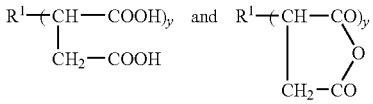

in which y represents the number of such succinic groups attached to the $R^1$ group. In one type of dispersant, y=1. In another type of dispersant, y is greater than 1, preferably greater than 1.3 or greater than 1.4; and most preferably y is equal to or greater than 1.5. Preferably y is 1.4 to 3.5, especially is 1.5 to 3.5 and most especially 1.5 to 2.5. Fractional values of y, of course, can arise because different specific $R^1$ chains may be reacted with different numbers of succinic groups.

The amines which are reacted with the succinic acylating agents to form the carboxylic dispersant composition can be monoamines or polyamines. In either case they will be characterized by the formula $R^4R^5NH$ wherein $R^4$ and $R^5$ are each independently hydrogen, or hydrocarbon, amino-substituted hydrocarbon, hydroxy-substituted hydrocarbon, alkoxy-substituted hydrocarbon, amino, carbamyl, thiocarbamyl, guanyl, and acylimidoyl groups provided that no more than one of $R^4$ and $R^5$ is hydrogen. In all cases, therefore, they will be characterized by the presence within their structure of at least one H—N< group. Therefore, they have at least one primary (i.e., $H_2N$—) or secondary amino (i.e., H—N<) group. Examples of monoamines include ethylamine, diethylamine, n-butylamine, di-n-butylamine, allylamine, isobutylamine, cocoamine, stearylamine, laurylamine, methyllaurylamine, oleyl-amine, N-methyl-octylamine, dodecylamine, and octadecylamine.

The polyamines from which the dispersant is derived include principally alkylene amines conforming, for the most part, to the formula

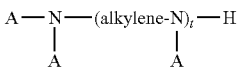

wherein t is an integer preferably less than 10, A is hydrogen or a hydrocarbyl group preferably having up to 30 carbon atoms, and the alkylene group is preferably an alkylene group having less than 8 carbon atoms. The alkylene amines include principally methylene amines, ethylene amines, hexylene amines, heptylene amines, octylene amines, other polymethylene amines. They are exemplified specifically by: ethylene diamine, diethylene triamine, triethylene tetramine, propylene diamine, decamethylene diamine, octamethylene diamine, di(heptamethylene) triamine, tripropylene tetramine, tetraethylene pentamine, trimethylene diamine, pentaethylene hexamine, di(-trimethylene) triamine. Higher homologues such as are obtained by condensing two or more of the above-illustrated alkylene amines likewise are useful. Tetraethylene pentamines is particularly useful.

The ethylene amines, also referred to as polyethylene polyamines, are especially useful. They are described in some detail under the heading "Ethylene Amines" in Encyclopedia of Chemical Technology, Kirk and Othmer, Vol. 5, pp. 898-905, Interscience Publishers, New York (1950).

Hydroxyalkyl-substituted alkylene amines, i.e., alkylene amines having one or more hydroxyalkyl substituents on the nitrogen atoms, likewise are useful. Examples of such amines include N-(2-hydroxyethyl)ethylene diamine, N,N'-bis(2-hydroxy-ethyl)-ethylene diamine, 1-(2-hydroxyethyl)-piperazine, monohydroxypropyl)-piperazine, di-hydroxypropy-substituted tetraethylene pentamine, N-(3-hydroxypropyl)-tetra-methylene diamine, and 2-heptadecyl-1-(2-hydroxyethyl)-imidazoline.

Higher homologues, such as are obtained by condensation of the above-illustrated alkylene amines or hydroxy alkyl-substituted alkylene amines through amino radicals or through hydroxy radicals, are likewise useful. Condensed polyamines are formed by a condensation reaction between at least one hydroxy compound with at least one polyamine reactant containing at least one primary or secondary amino group and are described in U.S. Pat. No. 5,230,714 (Steckel).

The succinimide dispersant is referred to as such since it normally contains nitrogen largely in the form of imide functionality, although it may be in the form of amine salts, amides, imidazolines as well as mixtures thereof. To prepare the succinimide dispersant, one or more of the succinic acid-producing compounds and one or more of the amines are heated, typically with removal of water, optionally in the presence of a normally liquid, substantially inert organic liquid solvent/diluent at an elevated temperature, generally in the range of 80° C. up to the decomposition point of the mixture or the product; typically 100° C. to 300° C.

The succinic acylating agent and the amine (or organic hydroxy compound, or mixture thereof) are typically reacted in amounts sufficient to provide at least one-half equivalent, per equivalent of acid-producing compound, of the amine (or hydroxy compound, as the case may be). Generally, the maximum amount of amine present will be about 2 moles of amine per equivalent of succinic acylating agent. For the purposes of this invention, an equivalent of the amine is that amount of the amine corresponding to the total weight of amine divided by the total number of nitrogen atoms present. The number of equivalents of succinic acid-producing compound will vary with the number of succinic groups present therein, and generally, there are two equivalents of acylating reagent for each succinic group in the acylating reagents. Additional details and examples of the procedures for preparing the succinimide dispersants of the present invention are included in, for example, U.S. Pat. Nos. 3,172,892; 3,219,666; 3,272,746; and 4,234,435.

The dispersants may be borated materials. Borated dispersants are well-known materials and can be prepared by treatment with a borating agent such as boric acid. Typical conditions include heating the dispersant with boric acid at 100 to 150° C. The dispersants may also be treated by reaction with maleic anhydride as described in PCT application US99/23940 filed 13 Oct. 1999.

The amount of the succinimide dispersant in a completely formulated lubricant will typically be 1.5 to 8 percent by weight, preferably 1.75 to 7 percent by weight or 2 to 6 percent by weight, and more preferably 2.2 to 5.5 percent by weight. Its concentration in a concentrate will be correspondingly increased to, e.g., 15 to 80 weight percent.

The Hindered Phenol Antioxidant. Hindered ester-substituted phenol antioxidants are typically alkyl phenols of the formula

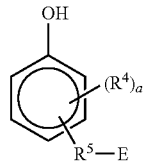

wherein $R^4$ is an alkyl group containing 1 to 24 carbon atoms and a is an integer of 1 to 5. Preferably $R^4$ contains 4 to 18 carbon atoms and most preferably 4 to 12 carbon atoms. $R^4$ may be either straight chained or branched chained; branched chained is generally preferred. The preferred value for a is 1 to 4 and most preferred 1 to 3 or, particularly, 2. Preferably the phenol is a butyl substituted phenol containing 2 or 3 t-butyl groups. $R^5$ is an alkylene group, preferably of 1 to 8 or 2 to 4 carbon atoms, and E is an ester group, that is, —C(O)$OR^3$ where $R^3$ is hydrocarbyl as further described below.

When a is 2, t-butyl groups preferably occupy the 2,6-positions, that is, the phenol is sterically hindered:

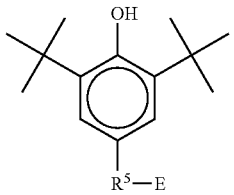

A particularly preferred antioxidant is a hindered, ester-substituted phenol represented by the formula

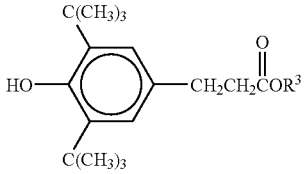

wherein $R^3$ is a straight chain or branched chain alkyl group containing 2 to 22 carbon atoms, preferably 2 to 8, 2 to 6, or 4 to 8 carbon atoms and more preferably 4 or 8 carbon atoms. $R^3$ is desirably a 2-ethylhexyl group or an n-butyl group.

Hindered, ester-substituted phenols can be prepared by heating a 2,6-dialkylphenol with an acrylate ester under base catalysis conditions, such as aqueous KOH. Such materials and their preparation are described in greater detail in PCT Patent Publication WO 01/74978.

The amount of the hindered ester-substituted phenol antioxidant is 0.8 to 4.0 percent by weight of the composition, preferably 0.85 or 0.9 or 1 or 1.2 percent, to 3.75 or 3.5 or 3.0 or 2.0 percent. Thus a preferred range could be 1 to 3.75 percent by weight. When used in a concentrate, the amounts will be proportionately higher, e.g., 8 to 40 percent by weight.

The Metal-Containing Detergent. The present invention also includes a metal-containing sulfonate detergent or a metal containing phenate detergent. Detergents generally are salts, and generally basic alkali or alkaline earth metal salts of an acidic organic compound (that is, the sulfonic acid or phenol). These salts are generally, but not necessarily, overbased materials. Overbased materials are single phase, homogeneous Newtonian systems characterized by a metal content in excess of that which would be present according to the stoichiometry of the metal and the particular acidic organic compound reacted with the metal. The amount of excess metal in an overbased detergent is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5.

The basicity of the overbased materials of the present invention can be expressed in terms of a total base number (ASTM D-2896). A total base number is the amount of acid (perchloric or hydrochloric) needed to neutralize all of the overbased material's basicity. The amount of acid is expressed as potassium hydroxide equivalents (mg KOH per gram of sample).

The overbased materials are prepared by reacting an acidic material (typically an inorganic acid or lower carboxylic acid, preferably carbon dioxide) with a mixture comprising an acidic organic compound, a reaction medium comprising at least one inert, organic solvent (such as mineral oil, naphtha, toluene, or xylene) for the sulfonic acid or phenol, a stoichiometric excess of a metal base, and a promoter.

The sulfonic acids useful in making the detergents of the invention include the sulfonic and thiosulfonic acids. Generally they are salts of sulfonic acids. The sulfonic acids include the mono- or polynuclear aromatic or cycloaliphatic compounds. The oil-soluble sulfonates can be represented for the most part by one of the following formulae: $R_2$-T-$(SO_3^-)_a$ and $R^3$—$(SO_3^-)_b$, wherein T is a cyclic nucleus such as, for example, benzene or naphthalene; $R_2$ is an aliphatic group such as alkyl, alkenyl, alkoxy, or alkoxyalkyl; and $R_3$ is an aliphatic hydrocarbyl group containing at least 15 carbon atoms.

Illustrative examples of these sulfonic acids include monoeicosanyl-substituted naphthalene sulfonic acids, dodecylbenzene sulfonic acids, didodecylbenzene sulfonic acids, dinonylbenzene sulfonic acids, dilauryl betanaphthalene sulfonic acids, and the sulfonic acid derived by the treatment of polybutene having a number average molecular weight ($\overline{M}_n$) in the range of 500 to 5000 with chlorosulfonic acid. Another group of sulfonic acids are mono-, di-, and tri-alkylated benzene and naphthalene sulfonic acids.

Specific examples of oil-soluble sulfonic acids are mahogany sulfonic acids; bright stock sulfonic acids; other substituted sulfonic acids such as alkyl benzene sulfonic acids; and alkaryl sulfonic acids such as dodecyl benzene "bottoms" sulfonic acids. Dodecyl benzene "bottoms" are the material leftover after the removal of dodecyl benzenes that are used to make dodecyl benzene sulfonic acid for household detergents. These materials are generally dialkylated benzenes or benzene alkylated with higher oligomers. The bottoms may be straight-chain or branched-chain alkylates with a straight-chain dialkylate preferred.

The production of sulfonates from detergent manufactured by-products by reaction with, e.g., $SO_3$, is well known to those skilled in the art. See, for example, the article "Sulfonates" in Kirk-Othmer "Encyclopedia of Chemical Technology", Second Edition, Vol. 19, pp. 291 et seq. published by John Wiley & Sons, N.Y. (1969).

The phenols useful in making the detergents of the present invention can be represented by the formula $(R_1)_a$—Ar—$(OH)_b$, wherein $R_1$ is a hydrocarbyl group that is directly bonded to the aromatic group Ar. $R_1$ preferably contains 6 to 80 carbon atoms, preferably 6 to 30 or 8 to 15 or 25 carbon atoms. $R_1$ groups may be derived from one or more of the above-described polyalkenes. Examples of the $R_1$ groups include butyl, isobutyl, pentyl, octyl, nonyl, dodecyl, and substituents derived from the above-described polyalkenes such as polyethylenes, polypropylenes, polyisobutylenes, ethylene-propylene copolymers, and oxidized ethylene-propylene copolymers.

In the above formula, Ar is an aromatic group, and a and b are independently numbers of at least one, the sum of a and b being in the range of two up to the number of displaceable hydrogens on the aromatic nucleus or nuclei of Ar. Preferably, a and b are each 1 to 4, more preferably 1 to 2. There are preferably an average of at least 8 aliphatic carbon atoms for each phenol compound.

While the term "phenol" is used herein, it is to be understood that this term is not intended to limit the aromatic group of the phenol to benzene. Accordingly, it is to be understood that the aromatic group as represented by "Ar", as well as elsewhere in this specification can be mononuclear such as a phenyl, a pyridyl, or a thienyl, or polynuclear of the fused or linked (bridged) type. In particular, "phenol" is intended to encompass hydrocarbyl-substituted bridged and substituted phenolic structures disclosed in greater detail in U.S. Pat. No. 6,310,009 (saligenin derivative detergents) and in U.S. Pat. No. 6,200,936 and PCT publication WO 01/56968 (salixarate detergents), both of which types generally comprise multiple hydrocarbyl-substituted phenolic aromatic rings bridged with alkylene (e.g., methylene) bridging groups.

The metal compounds useful in making the basic metal salts are preferably any Group 1 or Group 2 metal compounds (CAS version of the Periodic Table of the Elements). The Group 1 metals of the metal compound include Group 1a alkali metals (sodium, potassium, lithium, etc.) as well as Group 1b metals such as copper. The Group 1 metals are preferably sodium, potassium, lithium and copper, more preferably sodium or potassium, and more preferably sodium. The Group 2 metals of the metal base include the Group 2a alkaline earth metals (such as magnesium, calcium, and barium) as well as the Group 2b metals such as zinc or cadmium. Preferably the Group 2 metals are magnesium, calcium, barium, or zinc, preferably magnesium or calcium, more preferably calcium. Generally the metal compounds are delivered as metal salts. The anionic portion of the salt can be hydroxide, oxide, carbonate, borate, or nitrate.

Mixtures of sulfonate detergents and phenate detergents can be used, and, indeed, detergents based on other acid substrates (such as carboxylic acids) can also be present. Certain types of substrates may contain both carboxylic and phenolic functionality on the same aromatic ring, e.g., salicylates. Salicylates may be included in the compositions of the present invention, but they are not to be considered to count as the phenate detergent.

Patents specifically describing techniques for making basic salts of the above-described sulfonic acids and other acids include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109.

The overbased detergent can also be a borated complex. Borated complexes of this type can be prepared by heating the basic metal detergent with boric acid at 50-100° C., the number of equivalents of boric acid being roughly equal to the number of equivalents of metal in the salt. U.S. Pat. No. 3,929,650 discloses borated complexes and their preparation.

The amount of the detergent in the compositions of the present invention is conveniently expressed as the amount of the acid substrate (the sulfonic acid or phenol moiety), exclusive of the weight of the metal and other components such as $CO_3^{-2}$ which will normally be a part of an overbased detergent. Accordingly, the amount of the substrate should be at least 1.1 percent by weight of the lubricant formulation, preferably at least 1.2, or 1.3 percent. The upper limit is not particularly critical but for practical purposes the amount of the substrate will not generally exceed 5 percent or 4 percent, preferably 3 or 2 percent. Thus a preferred range can be 1.2 to 2 percent by weight, or, for instance, about 1.32 percent. In a concentrate the amounts will be corresponding increased, to, for example, at least 10 percent. For the purposes of calculating the amount of acid substrate present, the amount of the hindered phenol antioxidant is not included.

The relatively large amount of substrate for the detergent in the present invention can be provided, if desired, in a way which does not provide an undesirable excess of metal to the composition. That is, the detergent can be supplied in a relatively low TBN formulation, that is, with a relatively low metal ratio. In one embodiment, the detergent (in its commercial form, including the conventional amount of diluent oil, which is typically 40-50% of the detergent formulation) will exhibit a TBN of less than 210. It is sometimes desirable that the amount of metal in the formulation (expressed as Sulfated Ash, ASTM D-874) be 1.25 or 1.2 or 1.1 or 1.0 percent by weight, and even as low as 0.8 or 0.5 percent by weight. Reasonable lower limits for Sulfated Ash can be 0.2 or 0.3 percent, thus, preferred ranges would be 0.2 to 1.2 percent and 0.3 to 1.0 percent. The Sulfated Ash content will depend on the amount of the metal-containing detergent, as well as all other metal sources.

Optional Materials. The compositions of the present invention may also include, or exclude, other components which are commonly found in lubricating compositions. One such material is a metal salt of a phosphorus acid. Metal salts of the formula

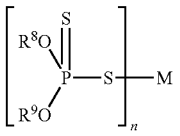

wherein $R^8$ and $R^9$ are independently hydrocarbyl groups containing 3 to 30 carbon atoms are readily obtainable by the reaction of phosphorus pentasulfide ($P_2S_5$ or $P_4S_{10}$) and an alcohol or phenol to form an O,O-dihydrocarbyl phosphorodithioic acid corresponding to the formula

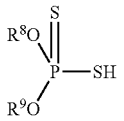

The reaction involves mixing at a temperature of 20° C. to 200° C., four moles of an alcohol or a phenol with one mole of phosphorus pentasulfide. Hydrogen sulfide is liberated in this reaction. The acid is then reacted with a basic metal compound to form the salt. The metal M, having a valence n, generally is aluminum lead, tin, manganese, cobalt, nickel, zinc, or copper, and most preferably zinc. The basic metal compound is thus preferably zinc oxide, and the resulting metal compound is represented by the formula

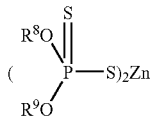

The $R^8$ and $R^9$ groups are independently hydrocarbyl groups that are preferably free from acetylenic and usually also from ethylenic unsaturation. They are typically alkyl, cycloalkyl, aralkyl or alkaryl group and have 3 to 20 carbon atoms, preferably 3 to 16 carbon atoms and most preferably up to 13 carbon atoms, e.g., 3 to 12 carbon atoms. The alcohols which react to provide the $R^8$ and $R^9$ groups can be one or more primary alcohols, one or more secondary alcohols, a mixture of one or more secondary alcohols and one or more primary alcohols. A mixture of two secondary alcohols such as isopropanol and 4-methyl-2-pentanol is often desirable.

Such materials are often referred to as zinc dialkyldithiophosphates or simply zinc dithiophosphates. They are well known and readily available to those skilled in the art of lubricant formulation.

The amount of the metal salt of a phosphorus acid in a completely formulated lubricant, if present, will typically be 0.1 to 5 percent by weight, preferably 0.3 to 2 percent by weight, and more preferably 0.5 to 1.5 percent by weight. Its concentration in a concentrate will be correspondingly increased, to, e.g., 5 to 60 weight percent. It is preferred that in the final formulation the total amount of phosphorus be at most 0.08 percent by weight, preferably 0.07 percent, 0.06 percent, or less. Typically a lubricant may not be entirely free from phosphorus, containing, for instance, 0.005 or 0.01 percent phosphorus. Thus one embodiment of the present invention can contain 0.005 to 0.07 percent phosphorus, e.g., 0.02 to 0.06 percent.

Other common additives may be used. These include corrosion inhibitors, extreme pressure agents, and anti-wear agents, which include chlorinated aliphatic hydrocarbons; boron-containing compounds including borate esters; and molybdenum compounds. Viscosity improvers include polyisobutenes, polymethyacrylate acid esters, polyacrylate acid esters, diene polymers, polyalkyl styrenes, alkenyl aryl conjugated diene copolymers, polyolefins such as ethylene/propylene copolymers, and multifunctional viscosity improvers, including dispersant viscosity modifiers (which impart both dispersancy and viscosity improvement). Pour point depressants are a particularly useful type of additive, often included in the lubricating oils, usually comprise substances such as polymethacrylates, styrene-based polymers, crosslinked alkyl phenols, or alkyl naphthalenes. See for example, page 8 of "Lubricant Additives" by C. V. Smalheer and R. Kennedy Smith (Lesius-Hiles Company Publishers, Cleveland, Ohio, 1967). Friction modifiers are known additives, which can include fatty amines, esters, especially glycerol esters such as glycerol monooleate, borated glycerol esters, fatty phosphites, fatty acid amides, fatty epoxides, borated fatty epoxides, alkoxylated fatty amines, borated alkoxylated fatty amines, metal salts of fatty acids, sulfurized olefins, fatty imidazolines, condensation products of carboxylic acids, polyalkylene-polyamines, amine salts of alkylphosphoric acids and molybdenum dithiocarbamates (Mo IV, V, or VI). Anti-foam agents used to reduce or prevent the formation of stable foam include silicones or organic polymers. Examples of these and additional anti-foam compositions are described in "Foam Control Agents", by Henry T. Kerner (Noyes Data Corporation, 1976), pages 125-162. Many of these and other additives which may be used in combination with the present invention are described in greater detail in U.S. Pat. No. 4,582,618 (column 14, line 52 through column 17, line 16, inclusive).

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not susceptible of easy description. Nevertheless, all such modifications and reaction products are included within the scope of the present invention; the present invention encompasses the composition prepared by admixing the components described above.

EXAMPLES

Example 1

A formulation is prepared in a 145N mineral base oil, comprising the following additive components, amounts expressed in percent by weight:

- 4.24% Condensed amine succinimide dispersant, containing 40% oil
- 1.24% Ca phenate detergent, TBN 145, containing 27% oil, 63% substrate (thus contributing 0.78% substrate to the formulation).
- 1.24% Ca alkylbenzenesulfonate detergent, TBN 85, containing 47% oil, 38% substrate (thus contributing 0.47% substrate to the formulation).
- 1.0% Hindered phenol-ester antioxidant, commercially available product
- 0.3% Zinc di(secondaryalkyl)dithiophosphate, containing 9% oil
- <0.01% Commercial silicone defoamer The formulation contains 0.03 percent by weight phosphorus and 1.3 percent substrate.

The above formulation is subjected to the panel coker test. This is a test that involves splashing test oil at 105° C. for 4 hours onto an aluminum panel maintained at 325° C. Digital imaging of resulting deposits provides a Universal Rating on a scale of 0-100, with higher ratings indicating better performance. The above formulation has a Universal Rating of 100. For reference purposes, the same formulation is reformulated by adding additional zinc dialkyldithiophosphate to provide a total of 0.09 percent by weight phosphorus in the formulation. This reference formulation exhibits a Universal Rating of 79, illustrating that formulations containing less than 0.08 percent phosphorus can be particularly desirable.

Example 2

Example 1 is substantially repeated except that 0.95 percent of a mixture of Ca phenate detergents is used, average TBN 216, percent oil 35, and percent substrate 47; 1.63 percent of a mixture of Ca alkylbenzene-sulfonate detergents is used, average TBN 217, percent oil 44, and percent substrate 32, and additionally 1.0. % of a formaldehyde-coupled Mg phenate detergent (a saligenin detergent) is used, TBN 69, containing 50% oil and 47% substrate. This formulation contains 1.5 percent substrate.

Example 3

Example 1 is substantially repeated except 1.19 percent of a mixture of Ca phenate detergents is used, average TBN 215, percent oil 35, and percent substrate 47; and 1.83 percent of a mixture of Ca alkylbenzenesulfonate detergents is used, average TBN 207, percent oil 44, and percent substrate 32. This formulation contains 1.2 percent substrate.

Example 4

Example 1 is substantially repeated except that the Ca phenate and Ca sulfonate detergents are replaced by 2.1% Mg phenate detergent, formaldehyde coupled, TBN 69, containing 50% oil and 47% substrate; 0.6% Ca alkylbenzene-sulfonate detergent, TBN 400, containing 42% oil and 19% substrate; and 1.04% Ca alkylphenate sulfide detergent, TBN 255, containing 39% oil and 38% substrate. This formulation contains 1.5 percent substrate.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A low-ash, low-phosphorus lubricant composition suitable for use in a stationary gas engine, comprising:

(a) a mineral oil of lubricating viscosity;

(b) about 2 to about 6 percent by weight of a succinimide dispersant wherein the amine-derived moiety thereof is a condensed polyamine;

(c) 1.0 to about 4.0 percent by weight of a hindered, ester-substituted phenol antioxidant represented by the formula

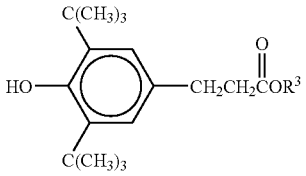

wherein $R^3$ is a straight chain or branched chain alkyl group containing 2 to 8 carbon atoms; and (d) at least one metal-containing sulfonate detergent or metal-containing phenate detergent, in an amount which provides 1.2 to 2.1 percent by weight of said sulfonate or phenate moieties exclusive of the weight of the metal moieties;

said lubricant containing up to about 0.06 percent by weight phosphorus and up to about 1.25 percent sulfated ash, wherein the phenate detergent is other than a salicylate detergent.

2. The composition of claim 1 wherein the metal in component (d) is calcium or magnesium or mixtures thereof.

3. The composition of claim 1 wherein the detergent of (d) is an overbased detergent.

4. The composition of claim 1 wherein the sulfated ash value of the composition is about 0.2 to about 1.2.

5. The composition of claim 1 further comprising a metal dialkyldithiophosphate.

6. The composition of claim 1 wherein the phosphorus content of the composition is about 0.02 to about 0.06 percent by weight.

7. The composition of claim 1 further comprising at least one viscosity modifier or pour point depressant.

8. The composition of claim 1 further comprising at least one friction modifier.

9. The composition prepared by combining the components of claim 1 in the amounts recited therein.

10. A method of lubricating a stationary gas engine, comprising supplying to said engine a low-ash, low-phosphorus lubricant composition comprising:

(a) a mineral oil of lubricating viscosity;

(b) about 2 to about 6 percent by weight of a succinimide dispersant wherein the amine-derived moiety thereof is a condensed polyamine;

(c) 1.0 to about 4.0 percent by weight of a hindered, ester-substituted phenol antioxidant represented by the formula

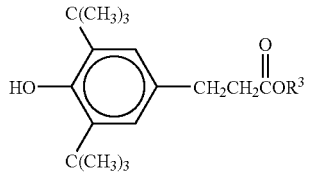

wherein $R^3$ is a straight chain or branched chain alkyl group containing 2 to 8 carbon atoms; and (d) at least one metal-containing sulfonate detergent or metal-containing phenate detergent, in an amount which provides 1.2 to 2.1 percent by weight of said sulfonate or phenate moieties exclusive of the weight of the metal moieties;

said lubricant containing up to about 0.06 percent by weight phosphorus and up to about 1.25 percent sulfated ash, wherein the phenate detergent is other than a salicylate detergent.

11. The method of claim 10 wherein the amount of the succinimide dispersant is about 2.2 to about 6 percent by weight.

12. The method of claim 1 wherein the amount of the succinimide dispersant is about 2.2 to about 6 percent by weight.

13. The lubricant composition of claim 1 wherein the amount of the hindered, ester-substituted phenol antioxidant is about 1.2 to about 4.0 percent by weight and wherein $R^3$ contains 4 to 8 carbon atoms.

* * * * *